US007453210B2

(12) United States Patent
Park

(10) Patent No.: US 7,453,210 B2
(45) Date of Patent: Nov. 18, 2008

(54) PLASMA DISPLAY PANEL WITH IMPROVED NIR SHIELDING

(75) Inventor: Yu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 11/290,563

(22) Filed: Dec. 1, 2005

(65) Prior Publication Data

US 2006/0119272 A1 Jun. 8, 2006

(30) Foreign Application Priority Data

Dec. 3, 2004 (KR) ..... 10-2004-0101449

(51) Int. Cl.
*H01J 17/49* (2006.01)

(52) U.S. Cl. ..... 313/587; 313/582; 313/586

(58) Field of Classification Search ..... 313/582–587, 313/111, 112, 116
See application file for complete search history.

(56) References Cited

U.S. PATENT DOCUMENTS 6,297,582 B1 * 10/2001 Hirota et al. ..... 313/110
2003/0085649 A1 * 5/2003 Wachi et al. ..... 313/479
2003/0102477 A1 * 6/2003 Lee ..... 257/72
2005/0280342 A1 * 12/2005 Wenz ..... 313/112

FOREIGN PATENT DOCUMENTS

| | | |
|---|---|---|
| EP | 1 176 436 A1 | 1/2002 |
| EP | 1 280 179 A2 | 1/2003 |
| JP | 11213895 A | 8/1999 |

* cited by examiner

*Primary Examiner*—Karabi Guharay
*Assistant Examiner*—Bumsuk Won
(74) *Attorney, Agent, or Firm*—Birch, Stewart, Kolasch & Birch, LLP

(57) ABSTRACT

The present invention relates to a plasma display panel, and more particularly, to the structure of a plasma display panel. The plasma display panel according to the present invention has a NIR shielding material included in any one of an upper dielectric layer, a protection film and an upper substrate. Therefore, NIR, which is radiated from the plasma display panel to the outside, can be shielded. As a result, in accordance with the present invention, a NIR shielding film can be obviated from the front filter, the plasma display panel can be made thin and the manufacturing cost can be saved.

18 Claims, 6 Drawing Sheets diimmonium-based material metal complex-based material

PLASMA DISPLAY PANEL WITH IMPROVED NIR SHIELDING

This Nonprovisional application claims priority under 35 U.S.C. § 119(a) on Patent Application No. 10-2004-0101449 filed in Korea on Dec. 3, 2004, the entire contents of which are hereby incorporated by reference.

BACKGROUND OF THE INVENTION

1. Field of the Invention

The present invention relates to a plasma display panel, and more particularly, to the structure of a plasma display panel.

2. Description of the Background Art

In general, in a plasma display panel, a barrier rib formed between an upper panel and a lower panel forms one unit cell. Each cell is filled with an inert gas comprising a primary discharge gas, such as neon (Ne), helium (He) or a mixed gas of Ne+He, and a small amount of xenon (Xe). If the inert gas is discharged with a high frequency voltage, it generates vacuum ultraviolet rays. Phosphors formed between the barrier ribs are excited to implement images.

More particularly, a three-electrode AC surface discharge type plasma display panel has advantages of lower voltage driving and longer product lifespan since wall charges are accumulated on a surface upon discharge and electrodes are protected from sputtering generated by a discharge.

FIG. 1 illustrates the structure of a plasma display panel in the related art.

Referring to FIG. 1, the discharge cell of the plasma display panel in the related art comprises scan electrodes Y and sustain electrodes Z formed on a bottom surface of an upper substrate 10, and address electrodes X formed on a lower substrate 18. The scan electrode Y comprises a transparent electrode 12Y, and a metal bus electrode 13Y, which has a line width smaller than that of the transparent electrode 12Y and is disposed at one side edge of the transparent electrode. Furthermore, the sustain electrode Z comprises a transparent electrode 12Z, and a metal bus electrode 13Z, which has a line width smaller than that of the transparent electrode 12Z and is disposed at one side edge of the transparent electrode.

The transparent electrodes 12Y, 12Z are generally formed of Indium Tin Oxide (ITO) and are formed on a bottom surface of the upper substrate 10. The metal bus electrodes 13Y, 13Z are generally formed of metal such as chromium (Cr) and are formed on the transparent electrodes 12Y, 12Z. The metal bus electrodes 13Y, 13Z serve to reduce a voltage drop caused by the transparent electrodes 12Y, 12Z having high resistance. On the bottom surface of the upper substrate 10 in which the scan electrodes Y and the sustain electrodes Z are formed parallel to each other is laminated an upper dielectric layer 14 and a protection layer 16. Wall charges generated during the discharge of plasma are accumulated on the upper dielectric layer 14. The protection layer 16 functions to prevent the upper dielectric layer 14 from being damaged by sputtering generated during the discharge of plasma and also to improve emission efficiency of secondary electrons. Magnesium oxide (MgO) is generally used as the protection layer 16.

A lower dielectric layer 22 and barrier ribs 24 are formed on the lower substrate 18 in which the address electrodes X are formed. A phosphor layer 26 is coated on the surfaces of the lower dielectric layer 22 and the barrier ribs 24. The address electrodes X are formed to cross the scan electrodes Y and the sustain electrodes Z. The barrier ribs 24 are formed parallel to the address electrodes X and function to prevent ultraviolet generated by a discharge and a visible ray from leaking to neighboring discharge cells. The phosphor layer 26 is excited with an ultraviolet generated during the discharge of plasma to generate any one visible ray of red, green and blue. An inert mixed gas is injected into discharge spaces provided between the upper substrate 10 and the barrier ribs 24 and between the lower substrate 18 and the barrier ribs 24.

FIG. 2 illustrates a method of implementing images of the plasma display panel in the related art.

As shown in FIG. 2, in the plasma display panel, one frame period is divided into a plurality of sub-fields having a different number of discharges. The plasma display panel is excited in a sub-field period corresponding to a gray level value of an input image signal, thereby implementing images.

Each sub-field is divided into a reset period for uniformly generating a discharge, an address period for selecting a discharge cell and a sustain period for implementing gray levels depending on the number of discharges. For example, if it is sought to display images with 256 gray levels, a frame period (16.67 ms) corresponding to 1/60 seconds is divided into eight sub-fields, as shown in FIG. 2.

Each of the eight sub-fields SF1 to SF8 is again divided into a reset period, an address period and a sustain period. In this case, the sustain period increases in the ratio of $2^n$ (where, n=0,1,2,3,4,5,6,7) in each sub-field. As described above, since the sustain period is varied in each sub-field, gray levels of images can be represented.

In the plasma display panel driven as described above, a versatile front filter is disposed on the upper substrate 10. In the related art, the front filter has been used in order to accomplish objects, such as Electromagnetic Interference (hereinafter referred to as "EMI") shielding, Near Infrared Rays (hereinafter referred to as "NIR") shielding, improved color purity and prevention of the reflection of external light. Since the front filter in the related art consists of a number of layers, however, a problem arises because the front filter has a predetermined or higher thickness. More particularly, the NIR shielding film included in the front filter is difficult to form using only a NIR shielding material. Therefore, there are problems in that the process time is long and the manufacturing cost is high.

SUMMARY OF THE INVENTION

Accordingly, an object of the present invention is to solve at least the problems and disadvantages of the background art.

It is an object of the present invention to provide a plasma display panel in which the manufacturing cost can be saved and the manufacturing process can be reduced.

It is another object of the present invention to provide a plasma display panel in which it can facilitate thinning.

A plasma display panel according to a first embodiment of the present invention comprises an upper substrate and a lower substrate that are connected with a predetermined distance therebetween, and an upper dielectric layer comprising a NIR shielding material that is formed on the upper substrate.

A plasma display panel according to a second embodiment of the present invention comprises an upper substrate and a lower substrate that are connected with a predetermined distance therebetween, an upper dielectric layer formed on the upper substrate, and a protection film comprising a NIR shielding material that is formed on the upper dielectric layer.

A plasma display panel according to a third embodiment of the present invention comprises an upper substrate comprising a NIR shielding material, and a lower substrate connected with the upper substrate with a predetermined distance therebetween.

The present invention is advantageous in that it can save the manufacturing cost and can reduce the manufacturing process.

The present invention is advantageous in that it can facilitate the thinning of a plasma display panel.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
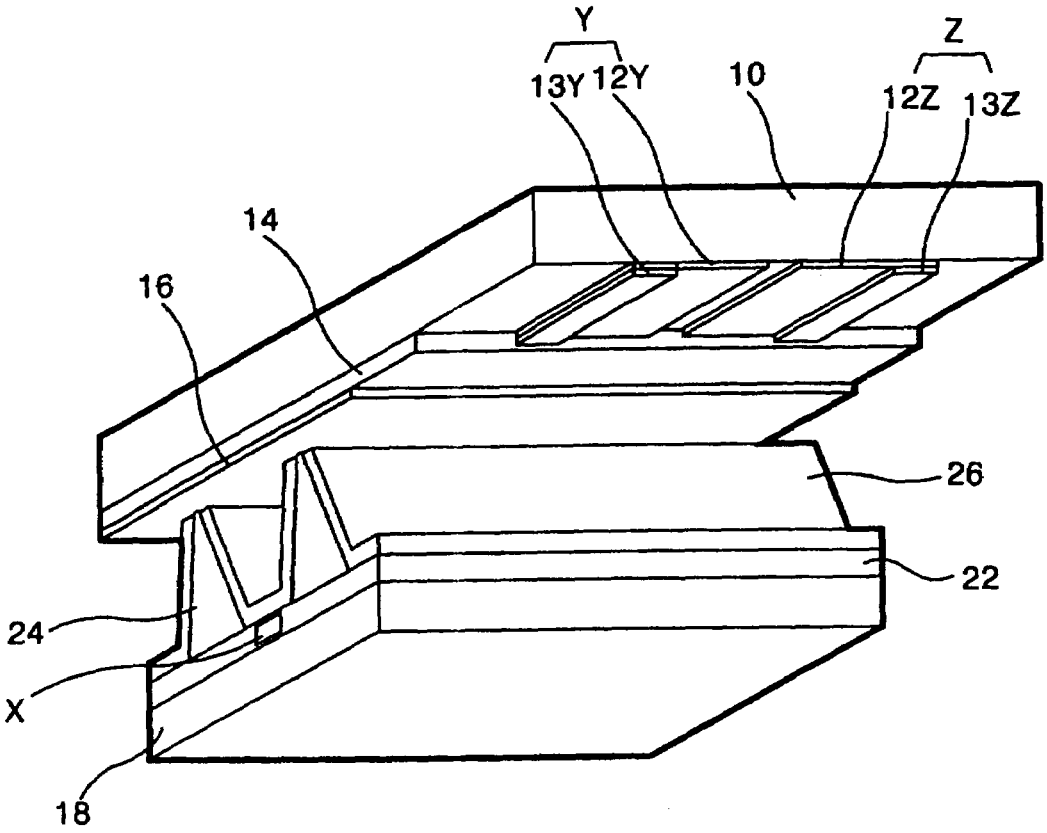
Fig. 1 [RELATED ART]
FIG. 1 illustrates the structure of a plasma display panel in the related art.
Figure 2:
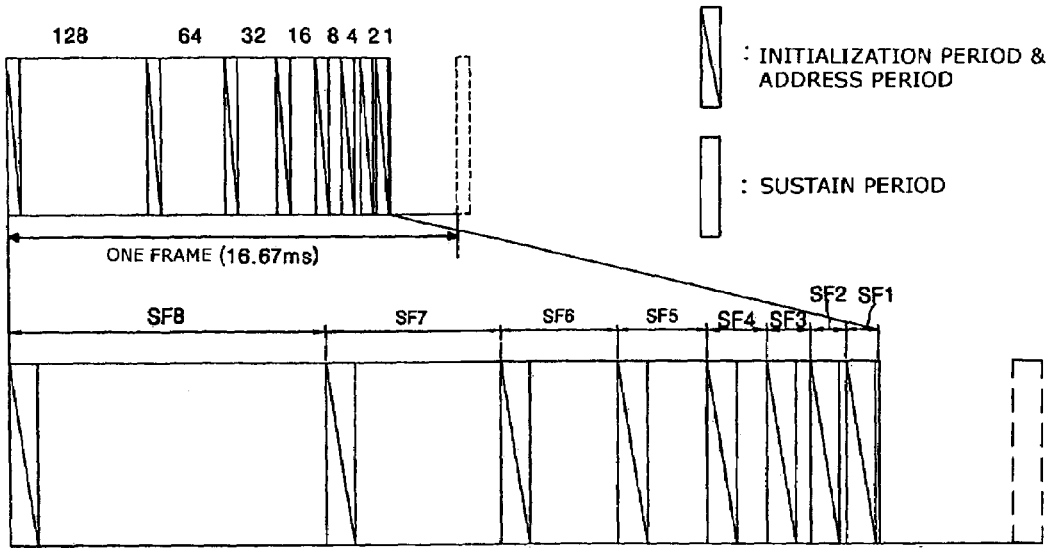
Fig. 2 [RELATED ART]
FIG. 2 illustrates a method of implementing images of the plasma display panel in the related art.

Preferred embodiments of the present invention will be described in a more detailed manner with reference to the drawings.

A plasma display panel according to a first embodiment of the present invention comprises an upper substrate and a lower substrate that are connected with a predetermined distance therebetween, and an upper dielectric layer comprising a NIR shielding material that is formed on the upper substrate.

1% to 50% of the upper dielectric layer comprises the NIR shielding material.

The NIR shielding material comprises at least one of a diimmonium-based material or a metal complex-based material.

The dielectric layer comprises at least two of the following dielectric layer forming materials; PbO, $SiO_2$, $B_2O_3$, $Al_2O_3$, ZnO, BaO, CoO or CuO.

The dielectric layer forming material and the NIR shielding material are mixed in a slurry or paste state and fired at a predetermined temperature to form a dielectric layer.

The predetermined temperature is 400° C. or less.

The plasma display panel further comprises a front filter, which is formed on the entire surface of the upper substrate and includes at least one of an AR film, an optical characteristic film, a glass or an EMI shielding film.

A plasma display panel according to a second embodiment of the present invention comprises an upper substrate and a lower substrate that are connected with a predetermined distance therebetween, an upper dielectric layer formed on the upper substrate, and a protection film comprising a NIR shielding material that is formed on the upper dielectric layer.

1% to 50% of the protection film comprises the NIR shielding material.

The NIR shielding material comprises at least one of a diimmonium-based material or a metal complex-based material.

The protection film comprises MgO.

The MgO and the NIR shielding material are mixed in a slurry or paste state and fired at a predetermined temperature to form a protection film.

The predetermined temperature is 400° C. or less.

The plasma display panel further comprises a front filter, which is formed on the entire surface of the upper substrate and includes at least one of an AR film, an optical characteristic film, a glass or an EMI shielding film.

A plasma display panel according to a third embodiment of the present invention comprises an upper substrate comprising a NIR shielding material, and a lower substrate connected with the upper substrate with a predetermined distance therebetween.

1% to 50% of the upper substrate comprises the NIR shielding material.

The NIR shielding material comprises at least one of a diimmonium-based material or a metal complex-based material.

A substrate forming material of the upper substrate and the NIR shielding material are mixed in a slurry or paste state and fired at a predetermined temperature to form a protection film.

The predetermined temperature is 400° C. or less.

The plasma display panel further comprises a front filter, which is formed on the entire surface of the upper substrate and includes at least one of an AR film, an optical characteristic film, a glass or an EMI shielding film.

Detailed embodiments of the present invention will now be described in connection with reference to the accompanying drawings.

First Embodiment

Figure 3:
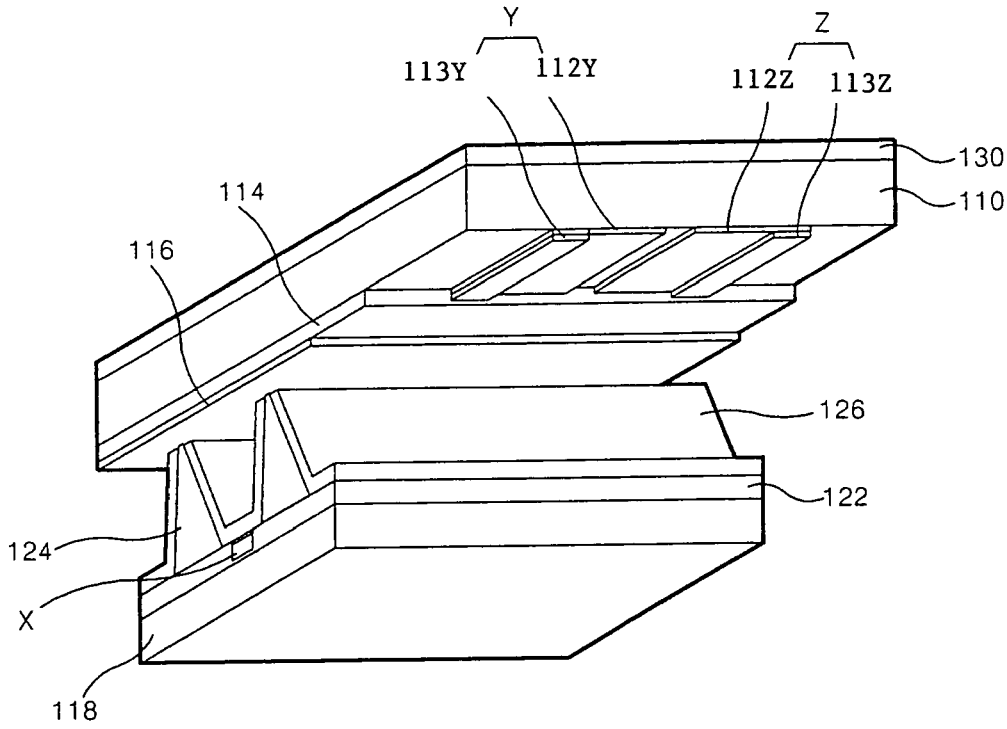
FIG. 3 illustrates a plasma display panel according to a first embodiment of the present invention.

FIG. 3 illustrates a plasma display panel according to a first embodiment of the present invention.

Referring to FIG. 3, the plasma display panel according to a first embodiment of the present invention comprises an upper substrate 110 and a lower substrate 118 that are connected with a predetermined distance therebetween.

Scan electrodes Y and sustain electrodes Z are formed on a bottom surface of the upper substrate 110. The scan electrode Y comprises a transparent electrode 112Y, and a metal bus electrode 113Y, which has a line width smaller than that of the transparent electrode 112Y and is disposed at one side edge of the transparent electrode. Furthermore, the sustain electrode Z comprises a transparent electrode 112Z, and a metal bus electrode 113Z, which has a line width smaller than that of the transparent electrode 112Z and is disposed at one side edge of the transparent electrode.

The transparent electrodes 112Y, 112Z are generally formed of ITO and are formed on the bottom surface of the upper substrate 110. The metal bus electrodes 113Y, 113Z are generally formed of metal, such as chromium (Cr), and are formed on the transparent electrodes 112Y, 112Z. The metal bus electrodes 113Y, 113Z function to reduce a voltage drop caused by the transparent electrodes 112Y, 112Z having high resistance.

An upper dielectric layer 114 and a protection layer 116 are laminated on the upper substrate 110 on which the scan electrodes Y and the sustain electrodes Z are formed in parallel. Wall charges generated during the discharge of plasma are accumulated on the upper dielectric layer 114. The protection layer 116 functions to prevent damage to the upper dielectric layer 114 by sputtering generated during the discharge of plasma and also to improve emission efficiency of secondary electrons. Magnesium oxide (MgO) is generally used as the protection layer 116.

The upper dielectric layer 114 according to a first embodiment of the present invention comprises a NIR shielding material for shielding NIR. The NIR shielding material functions to prevent NIR having a predetermined value or higher from being radiated from the plasma display panel to the outside so that signals can be normally transferred from a remote controller, etc., to the plasma display panel. If the NIR shielding material is included in the upper dielectric layer 114, the NIR shielding film that has been included in the front filter 130 in the related art can be obviated. Detailed description thereof will be described later on.

An address electrode X is formed on the lower substrate 118. A lower dielectric layer 122 and barrier ribs 124 are laminated on the lower substrate 118 on which the address electrode X is formed. A phosphor layer 126 is coated on the surfaces of the lower dielectric layer 122 and the barrier ribs 124.

The address electrode X are formed to cross the scan electrodes Y and the sustain electrodes Z. The lower dielectric layer 122 protects the address electrode X and reflects a visible ray generated by a discharge toward the upper substrate 110. The barrier ribs 124 can have a stripe form or a lattice form, and function to prevent ultraviolet rays generated by a discharge and a visible ray from leaking to neighboring discharge cells.

The phosphor layer 126 is excited by ultraviolet rays generated during the discharge of plasma to generate any one of red, green and blue visible rays. An inert mixed gas is injected into discharge spaces provided by the upper substrate 110, the lower substrate 118 and the barrier ribs 124.

Meanwhile, in the first embodiment according to the present invention, a front filter 130 is formed on the entire surface of the upper substrate 110. The front filter 130 shields EMI and also prevents the reflection of external light. The front filter 130 according to the first embodiment of the present invention does not comprise the NIR shielding film, as shown in FIG. 4.

Figure 4:
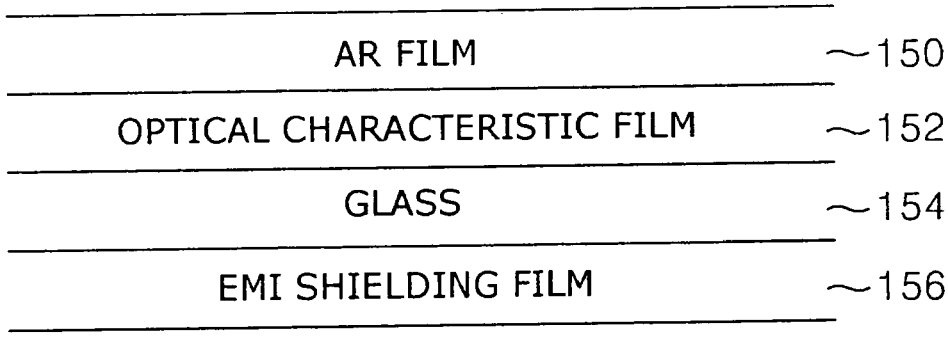
FIG. 4 a detailed view of a front filter according to a first embodiment of the present invention.

FIG. 4 is a detailed view of the front filter according to the first embodiment of the present invention.

As shown in FIG. 4, the front filter 130 according to the first embodiment of the present invention consists of at least one of an Anti-Reflection (AR) film 150, an optical characteristic film 152, a glass 154 and an EMI shielding film 156. That is, the front filter 130 can comprise any one or two or more of the AR film 150, the optical characteristic film 152, the glass 154 and the EMI shielding film 156, wherein the NIR shielding film is obviated unlike the related art.

The AR film 150 functions to prevent light, which is incident on the plasma display panel from the outside, from being externally reflected again. It is thus possible to improve bright room contrast of the plasma display panel.

The optical characteristic film 152 absorbs light of a yellow wavelength, which is generated when the plasma display panel is discharged. Therefore, the color purity of red light of the plasma display panel can be relatively enhanced.

The glass 154 functions to support the front filter 130 and to prevent the front filter 130 from being damaged by external shock. The glass 154 may not be included in the front filter 130.

The EMI shielding film 56 shields EMI to prevent EMI, which is generated when the plasma display panel is driven, from being radiated to the outside.

Furthermore, in the first embodiment of the present invention, an adhesive layer (not shown) may be additionally formed between the films 150, 152, 154 and 156 of the front filter 130.

If the NIR shielding film is not included in the front filter 130 as described above, the plasma display panel can be made further thin in comparison with the related art. Furthermore, since an additional NIR shielding film is not formed, not only the manufacturing cost can be saved, but also the process time can be shortened.

Figure 5:
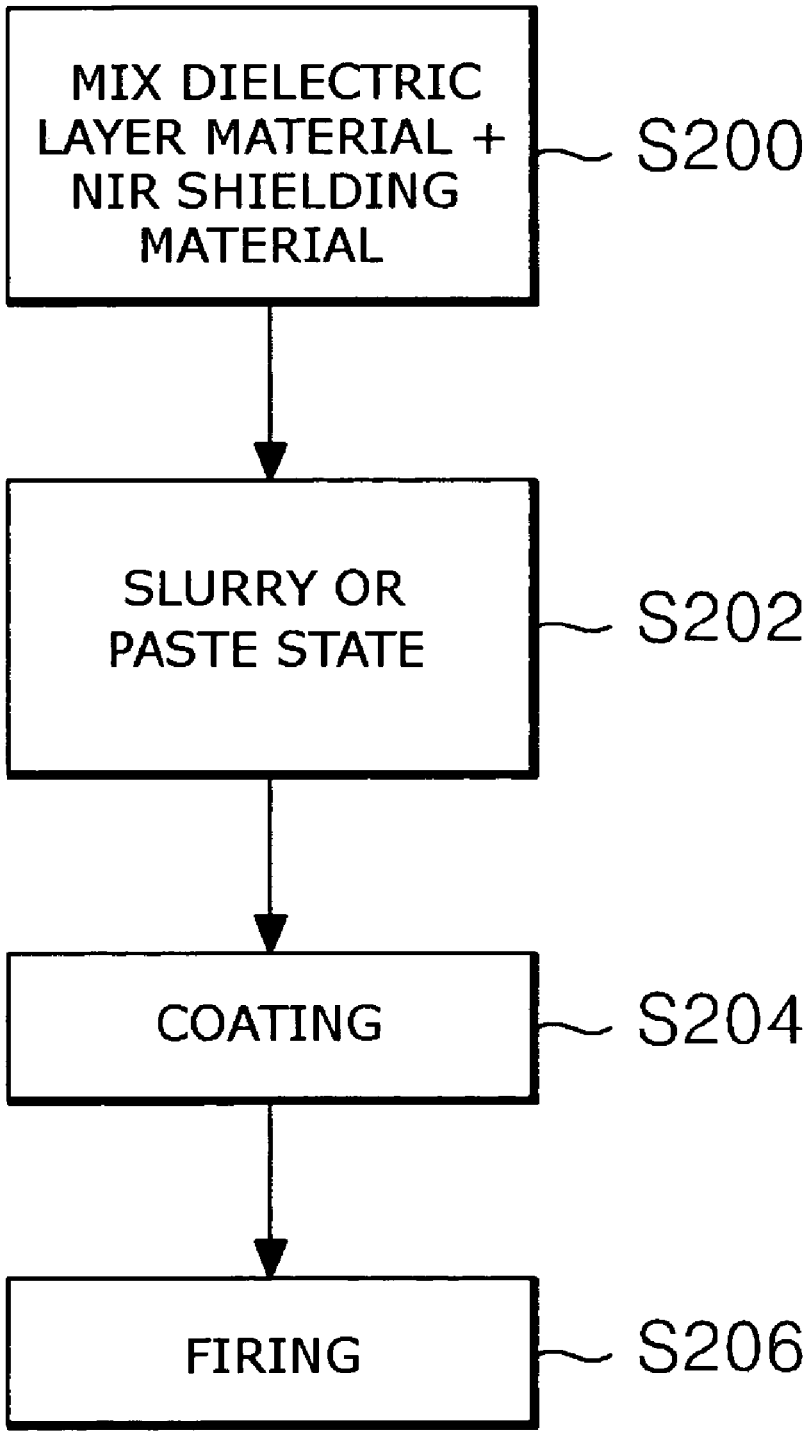
FIG. 5 illustrates a process of forming an upper dielectric layer according to a first embodiment of the present invention.

FIG. 5 illustrates a process of forming the upper dielectric layer according to the first embodiment of the present invention.

Figure 6A:
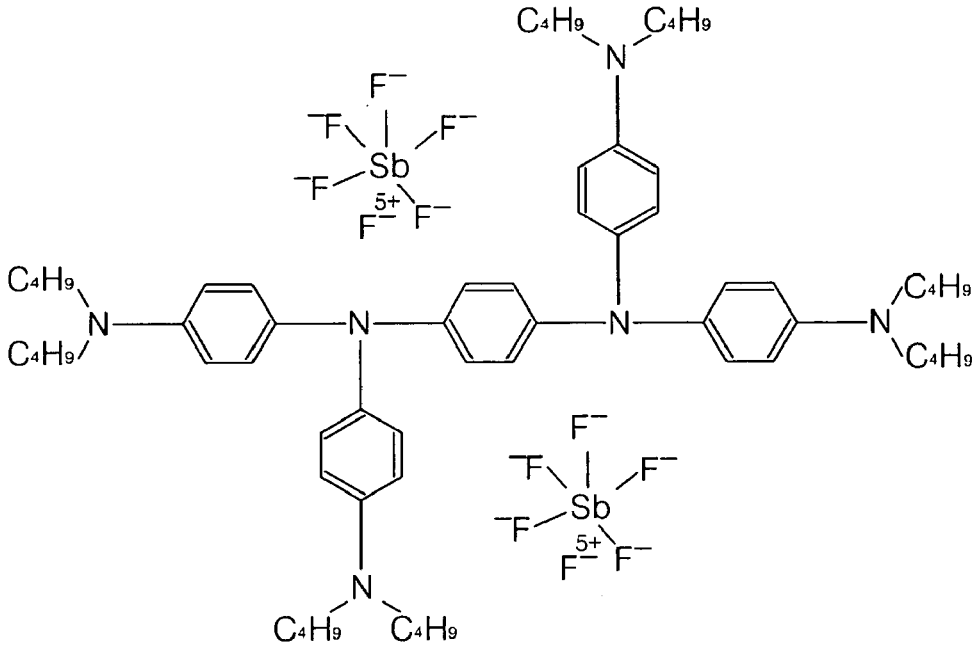
FIGS. 6*a* and 6*b* illustrate the molecular structure of the NIR material according to an embodiment of the present invention.
Figure 6B:
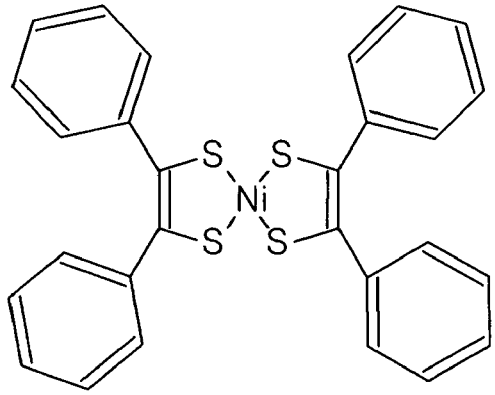

Referring to FIG. 5, a dielectric layer forming material and a NIR shielding material are mixed at step S200. The dielectric layer forming material can be PbO, $SiO_2$, $B_2O_3$, $Al_2O_3$, ZnO, BaO, CoO and/or or CuO and the NIR shielding material can be a diimmonium-based material of FIG. 6*a* or a metal complex-based material of FIG. 6*b*. The dielectric layer can comprise at least two or more of the aforementioned dielectric layer forming materials and at least one of the above-described NIR shielding materials. The NIR shielding material included in the protection film can range from 1% to 50% of a total percentage of the protection film so that a NIR shielding characteristic and a dielectric characteristic can effectively exhibit. For convenience of explanation, a mixture of the dielectric layer material and the NIR shielding material will be hereinafter referred to as a "first mixed material".

The first mixed material is changed into a slurry or paste state so that it can be coated on the upper substrate at step S202. To this end, a predetermined solvent is added to the first mixed material. The solvent can be a known solution used to change the dielectric layer forming material into a slurry or paste state.

Thereafter, the first mixed material changed into the slurry or paste state is coated on the upper substrate at step S204. The coating method may include a slot coater method of coating the first mixed material on the upper substrate located in a carrier table using a slurry or paste supply unit. The coating method may also include a roll coater method using a roll, a green sheet lamination method using a green sheet and the like.

The coated first mixed material is fired at a predetermined temperature, thereby completing the upper dielectric layer formation process at step S206. The sintering temperature when the first mixed material is fired can be set to approximately 400° C. or less. In more detail, in general, the NIR shielding material is degraded at a temperature of 400° C. or higher. Therefore, when the first mixed material is fired, the sintering temperature is set to 400° C. or less in order to prevent the NIR shielding film forming material from being degraded. For this reason, the dielectric layer forming material can be preferably a material that can be fired at low temperature. For example, the dielectric layer forming material can be a known material that can be fired at low temperature.

The upper dielectric layer formed of the first mixed material serves as both the dielectric layer and the NIR shielding film. In other words, predetermined wall charges are formed in the upper dielectric layer by a discharge. Furthermore, the upper dielectric layer functions to prevent NIR generated during the discharge of plasma from being radiated to the outside.

Second Embodiment

A plasma display panel according to a second embodiment of the present invention comprises an upper substrate and a lower substrate that are connected with a predetermined distance therebetween, in the same manner as the plasma display panel according to the first embodiment of the present invention.

Scan electrodes and sustain electrodes are formed on a bottom surface of the upper substrate. The scan electrode comprises a transparent electrode, and a metal bus electrode, which has a line width smaller than that of the transparent electrode and is disposed at one side edge of the transparent electrode. Furthermore, the sustain electrode comprises a transparent electrode, and a metal bus electrode, which has a line width smaller than that of the transparent electrode and is disposed at one side edge of the transparent electrode. Furthermore, an upper dielectric layer and a protection layer are laminated on the upper substrate on which the scan electrodes and the sustain electrodes are formed in parallel.

In this case, the protection film according to the second embodiment of the present invention comprises a NIR shielding material for shielding NIR. The NIR shielding material functions to prevent NIR having a predetermined value or higher from being radiated from the plasma display panel to the outside so that signals can be normally transferred from a remote controller, etc., to the plasma display panel. If the NIR shielding material is included in the protection film, the NIR shielding film that has been included in the front filter 130 in the related art can be obviated.

An address electrode is formed on the lower substrate. A lower dielectric layer and barrier ribs are laminated on the lower substrate on which the address electrode is formed. A phosphor layer is coated on the surfaces of the lower dielectric layer and the barrier ribs. In this case, description on each of the constituent elements other than the protection film is substantially the same as that of the plasma display panel according to a first embodiment of the present invention shown in FIG. 3. Therefore, description thereof will be omitted in order to avoid redundancy.

Meanwhile, even in the second embodiment of the present invention, a front substrate comprising at least one of an AR film, an optical characteristic film, a glass and an EMI shielding film is formed on the entire surface of the upper substrate. This obviates the NIR shielding film unlike the related art. If the NIR shielding film is not included in the front filter as described above, the plasma display panel can be made further thin in comparison with the prior art. Furthermore, since an additional NIR shielding film is not formed, not only the manufacturing cost can be saved, but also the process time can be shortened.

Figure 7:
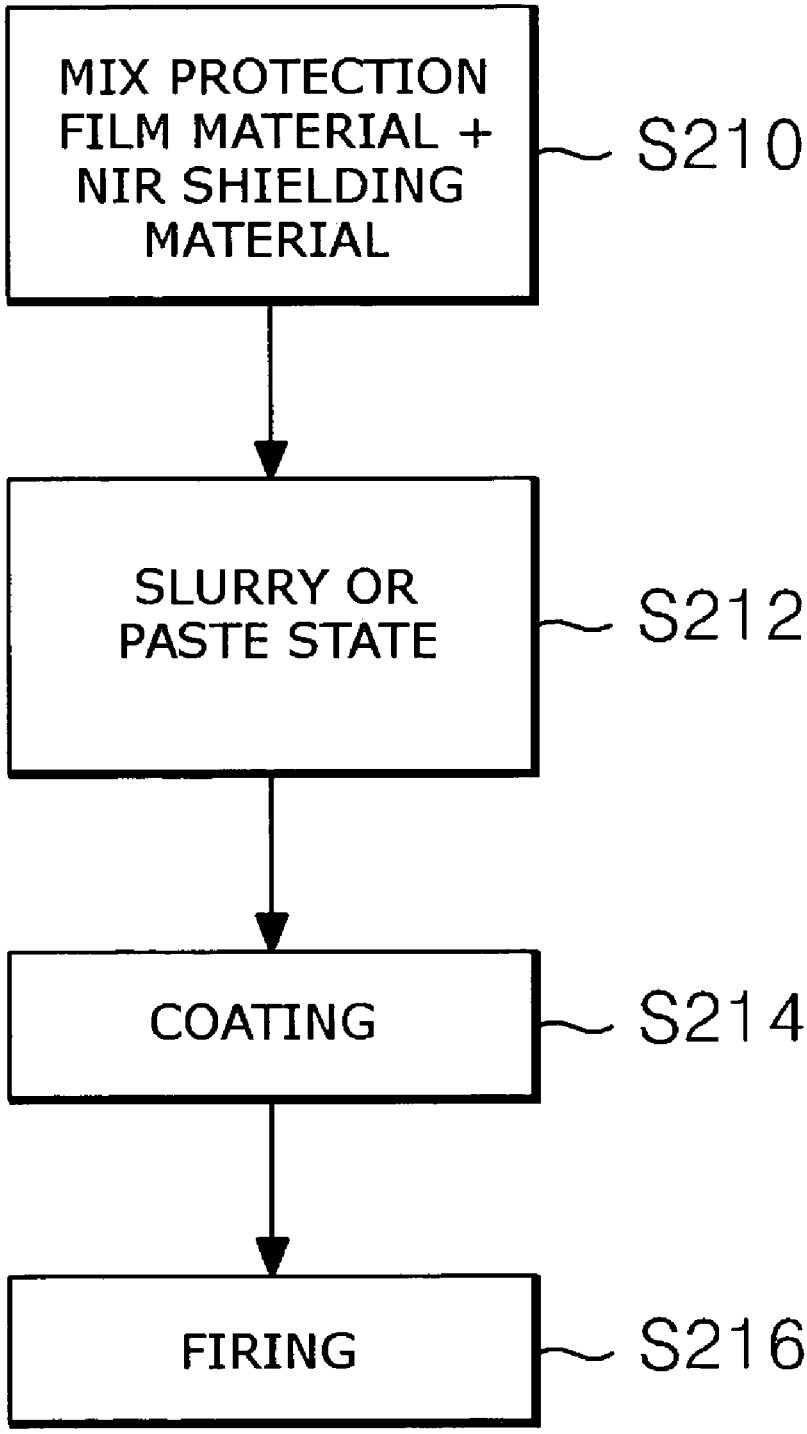
FIG. 7 illustrates a process of forming a protection film according to a second embodiment of the present invention.

FIG. 7 illustrates a process of forming a protection film according to a second embodiment of the present invention.

Referring to FIG. 7, a protection film forming material and a NIR shielding material are mixed at step S210. The protection film forming material can be a material comprising MgO. The NIR shielding material can be a diimmonium-based material of FIG. 6*a* or a metal complex-based material of FIG. 6*b*. The protection film can comprise at least one of the diimmonium-based material and the metal complex-based material and MgO. The NIR shielding material included in the protection film can range from 1% to 50% of a total percentage of the protection film so that a NIR shielding characteristic and a dielectric characteristic can effectively exhibit. For convenience of explanation, a mixture of the protection film material and the NIR shielding material will be hereinafter referred to as a "second mixed material".

The second mixed material is changed into a slurry or paste state so that it can be coated on the upper dielectric film at step S212. To this end, a predetermined solvent is added to the second mixed material. The solvent can be a well-known solution used to change the protection film forming material into a slurry or paste state.

Thereafter, the second mixed material changed into the slurry or paste state is coated on the upper dielectric film at step S214. The coating method may be a slot coater method of coating the second mixed material on the upper substrate in which the upper dielectric layer located in a carrier table is formed by using a slurry or paste supply unit. The coating method may also include a roll coater method using a roll, a green sheet lamination method using a green sheet and so on.

The coated second mixed material is fired at a predetermined temperature, thereby completing the protection film formation process at step S216. The sintering temperature when the second mixed material is fired can be set to approximately 400° C. or less in order to prevent the NIR shielding film forming material from being degraded.

The protection film formed of the second mixed material serves as both the protection film and the NIR shielding film. In other words, the protection film functions to protect the upper dielectric layer and to shield NIR generated by a discharge so that the generated NIR is not radiated to the outside.

Third Embodiment

A plasma display panel according to a third embodiment of the present invention comprises an upper substrate and a lower substrate that are connected with a predetermined distance therebetween, in the same manner as the plasma display panel according to the first and second embodiments of the present invention.

In the third embodiment of the present invention, a NIR shielding material for shielding NIR is comprised in the upper substrate unlike the first and the second embodiment of the present invention. Therefore, the NIR shielding film that has been included in the front filter in the related art can be obviated.

An address electrode is formed on the lower substrate. A lower dielectric layer and barrier ribs are laminated on the lower substrate on which the address electrode is formed. A phosphor layer is coated on the surfaces of the lower dielectric layer and the barrier ribs. In this case, description on each of the constituent elements other than the protection film is substantially the same as that of the plasma display panel according to a first embodiment of the present invention shown in FIG. 3. Therefore, description thereof will be omitted in order to avoid redundancy.

Meanwhile, even in the third embodiment of the present invention, a front substrate comprising at least one of an AR film, an optical characteristic film, a glass and an EMI shielding film is formed on the entire surface of the upper substrate. This obviates the NIR shielding film unlike the related art. If the NIR shielding film is not included in the front filter as described above, the plasma display panel can be made further thin in comparison with the prior art. Furthermore, since an additional NIR shielding film is not formed, not only the manufacturing cost can be saved, but also the process time can be shortened.

Furthermore, the upper substrate according to the third embodiment of the present invention is formed by mixing any one of NIR shielding materials such as a diimmonium-based material and a metal complex-based material, and a substrate forming material of the upper substrate in a slurry or paste state. The NIR shielding material included in the protection film can range from 1% to 50% of a total percentage of the upper substrate. Furthermore, a sintering temperature when the upper substrate is fired can be set to approximately 400° C. or less in order to prevent the NIR material from being degraded.

In the plasma display panel according to the present invention, the NIR shielding material is included in at least one of the upper dielectric layer, the protection film and the upper substrate as described above. Therefore, NIR, which is radiated from the plasma display panel to the outside, can be shielded. As a result, in accordance with the present invention, the NIR shielding film can be obviated from the front filter, the plasma display panel can be made thin and the manufacturing cost can be saved.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A plasma display panel, comprising:

an upper substrate and a lower substrate that are connected with a predetermined distance therebetween;

an upper dielectric layer comprising a NIR shielding material that is formed on the upper substrate; and a front filter substantially devoid of NIR shielding material and formed on an entire surface of the upper substrate, the front filter including an AR film layered directly on an optical characteristic film layered directly on a glass layered directly on an EMI shielding film.

2. The plasma display panel as claimed in claim 1, wherein 1% to 50% of the upper dielectric layer comprises the NIR shielding material.

3. The plasma display panel as claimed in claim 1, wherein the NIR shielding material comprises a diimmonium-based material.

4. The plasma display panel as claimed in claim 3, wherein the NIR shielding material further comprises a metal complex-based material.

5. The plasma display panel as claimed in claim 1, wherein the dielectric layer comprises at least two of the following dielectric layer forming materials: PbO, $SiO_2$, $B_2O_3$, $Al_2O_3$, ZnO, BaO, CoO or CuO.

6. The plasma display panel as claimed in claim 5, wherein the dielectric layer forming material and the NIR shielding material are mixed in a slurry or paste state and fired at a predetermined temperature to form a dielectric layer.

7. The plasma display panel as claimed in claim 6, wherein the predetermined temperature is 400° C. or less.

8. The plasma display panel as claimed in claim 1, wherein the NIR shielding material comprises a metal complex-based material.

9. The plasma display panel as claimed in claim 1, wherein the AR film is layered directly on the optical characteristic film via a first adhesive, the optical characteristic film is layered directly on the glass via a second adhesive, and the glass is layered directly on the EMI shielding film via a third adhesive.

10. A plasma display panel comprising: an upper substrate and a lower substrate that are connected with a predetermined distance therebetween; an upper dielectric layer formed on the upper substrate; a protection film comprising NIR shielding material that is formed on the upper dielectric layer; and a front filter substantially devoid of NIR shielding material, which is formed on the entire surface of the upper substrate and includes an AR film layered directly on an optical characteristic film layered directly on a glass layered on an EMI shielding film.

11. The plasma display panel as claimed in claim 10, wherein 1% to 50% of the protection film comprises the NIR shielding material.

12. The plasma display panel as claimed in claim 10, wherein the NIR shielding material comprises a diimmonium-based material.

13. The plasma display panel as claimed in claim 12, wherein the NIR shielding material further comprises a metal complex-based material.

14. The plasma display panel as claimed in claim 10, wherein the protection film comprises MgO.

15. The plasma display panel as claimed in claim 10, wherein the NIR shielding material comprises a metal complex-based material.

16. The plasma display panel as claimed in claim 10, wherein the AR film is layered directly on the optical characteristic film via a first adhesive, the optical characteristic film is directly on the glass via a second adhesive, and the glass is layered directly on the EMI shielding film via a third adhesive.

17. A plasma display panel comprising:

an upper substrate comprising a NIR shielding material; and a lower substrate connected with the upper substrate with a predetermined distance therebetween, wherein the NIR shielding material comprises a diimmonium-based material, the plasma display panel further comprising:

a front filter substantially devoid of NIR shielding material, which is formed on the entire surface of the upper substrate and includes an AR film layered directly on an optical characteristic film layered directly on a glass layered directly on an EMI shielding film.

18. The plasma display panel as claimed in claim 17, wherein the AR film is layered directly on the optical characteristic film via a first adhesive, the optical characteristic film is layered directly on the glass via a second adhesive, and the glass is layered directly on the EMI shielding film via a third adhesive.

* * * * *